US006554692B2

(12) United States Patent
Knox, Jr. et al.

(10) Patent No.: US 6,554,692 B2
(45) Date of Patent: Apr. 29, 2003

(54) COIN SORTING AND AMUSEMENT DEVICE

(75) Inventors: William J. Knox, Jr., Painesville, OH (US); John R. Nottingham, Hunting Valley, OH (US); John W. Spirk, Gates Mills, OH (US); Patrick W. Brown, Mantua, OH (US)

(73) Assignee: Mag-Nif Incorporated, Mentor, OH (US)

( * ) Notice: Subject to any disclaimer, the term of this patent is extended or adjusted under 35 U.S.C. 154(b) by 102 days.

(21) Appl. No.: 09/780,815

(22) Filed: Feb. 9, 2001

(65) Prior Publication Data

US 2002/0111129 A1 Aug. 15, 2002

(51) Int. Cl.[7] ..... G07D 3/00
(52) U.S. Cl. ..... 453/3; 446/8
(58) Field of Search ..... 453/3, 9, 14, 15, 453/63; 446/8, 168; 273/459; 232/1 R, 4 R; 235/1 E

(56) References Cited

U.S. PATENT DOCUMENTS

| | | | | |
|---|---|---|---|---|
| 3,125,104 A | | 3/1964 | Tryon | 133/5 |
| 3,276,457 A | | 10/1966 | Edds | 133/4 |
| 3,590,833 A | * | 7/1971 | Walton | 194/353 |
| 3,814,115 A | | 6/1974 | Van Acker | 133/4 |
| 4,250,905 A | | 2/1981 | Kobayashi et al. | 133/5 R |
| 4,374,529 A | | 2/1983 | Kobayashi et al. | 133/4 A |
| 4,607,648 A | * | 8/1986 | Hough | 446/8 |
| 5,902,178 A | | 5/1999 | Perkitny | 453/9 |
| 5,976,006 A | | 11/1999 | Snyder | 453/9 |
| 6,165,063 A | * | 12/2000 | Perkitny | 453/61 |

FOREIGN PATENT DOCUMENTS

| | | | | |
|---|---|---|---|---|
| GB | 2 130 779 A | * | 6/1984 | G07D/9/00 |

OTHER PUBLICATIONS

Mag–Nif product list—"Mag–Nif makes it in the U.S.A." 1999.

Mag–Nif Makes it in the U.S.A.!, (Banks, Games, & Puzzles, Just for Fun!, 1998.

* cited by examiner

*Primary Examiner*—Donald P. Walsh
*Assistant Examiner*—Mark J. Beauchaine
(74) *Attorney, Agent, or Firm*—Fay, Sharpe, Fagan, Minnich & McKee, LLP

(57) ABSTRACT

A coin sorting apparatus includes a housing and a coin transport assembly that receives individual associated coins from an entrance and moves the coins upwardly in the housing from a first elevation to a higher elevation relative to a support surface. A coin sorting assembly includes an inlet positioned to receive coins from the transport assembly. The coin sorting assembly includes a coin sorter that classifies coins according to their diameter. A plurality of coin chutes are located to receive coins from the coin sorter and convey received coins to a plurality of sorted coin chambers. A manual drive system is operably coupled to the coin transport assembly. A movable member is externally connected to the housing and is coupled to the manual drive system so that it moves between first and second positions in response to operation of the manual drive system.

31 Claims, 9 Drawing Sheets

COIN SORTING AND AMUSEMENT DEVICE

BACKGROUND OF THE INVENTION

Coin sorting devices are generally known. A user places one or more coins into a hopper or similar coin input location. A manually-operated or motorized coin separating mechanism dispenses coins one at a time from the input location to a sorting location where the coins are classified and sorted according to their diameter. Coins of a particular diameter, and consequently of a particular denomination, are directed into the appropriate one of a plurality of sorted coin storage containers and/or wrappers.

Coin sorting devices of the type described above are very effective and have enjoyed widespread commercial success. However, to increase the appeal of coin sorting devices to children and others, a need has been identified for a new and unobvious novelty coin sorting device.

SUMMARY OF THE INVENTION

According to the present invention, a new and improved novelty coin sorting apparatus is provided.

In accordance with the present invention, a coin sorting apparatus includes a housing and a coin transport assembly that receives individual associated coins from an entrance and moves the coins upwardly in the housing from a first elevation to a higher elevation relative to a support surface. A coin sorting assembly includes an inlet positioned to receive coins from the transport assembly. The coin sorting assembly includes a coin sorter that classifies coins according to their diameter. A plurality of coin chutes are located to receive coins from the coin sorter and convey received coins to a plurality of sorted coin chambers. A manual drive system is operably coupled to the coin transport assembly. A movable member is externally connected to the housing and is coupled to the manual drive system so that it moves between first and second positions in response to operation of the manual drive system.

One advantage of the present invention is the provision of a new and improved novelty coin sorting apparatus.

Another advantage of the present invention resides in the provision of a coin sorting apparatus wherein a support base of the coin sorting apparatus us divided into multiple compartments to receive and retain sorted coins.

Still another advantage of the present invention is found in the provision of a coin sorting apparatus having an upper body portion and a base portion, wherein the base portion, itself, includes multiple sections, each of which supports said upper body portion above a support surface and defines a sorted coin-receiving compartment.

A further advantage of the present invention resides in the provision of a novelty coin sorting apparatus wherein operation of the coin separating mechanism causes operation of an associated novelty amusement feature of the coin sorting apparatus.

Still another advantage of the present invention is the provision of a novelty coin sorting apparatus wherein a member reciprocates toward and away from an associated housing portion during operation of the coin separating mechanism.

A yet further advantage of the present invention is found in the provision of a novelty coin sorting apparatus wherein a coin transport member reciprocates between a first position, wherein the member is retracted relative to the housing of the apparatus, and an extended position wherein a portion of the member is extended and projects outwardly from the housing.

Still other benefits and advantages of the invention will become apparent to those skilled in the art upon reading and understanding the following detailed description.

BRIEF DESCRIPTION OF THE DRAWINGS

The invention comprises certain components and structures, a preferred embodiment of which is illustrated in the accompanying drawings wherein.

DETAILED DESCRIPTION OF PREFERRED EMBODIMENTS

Figure 1:
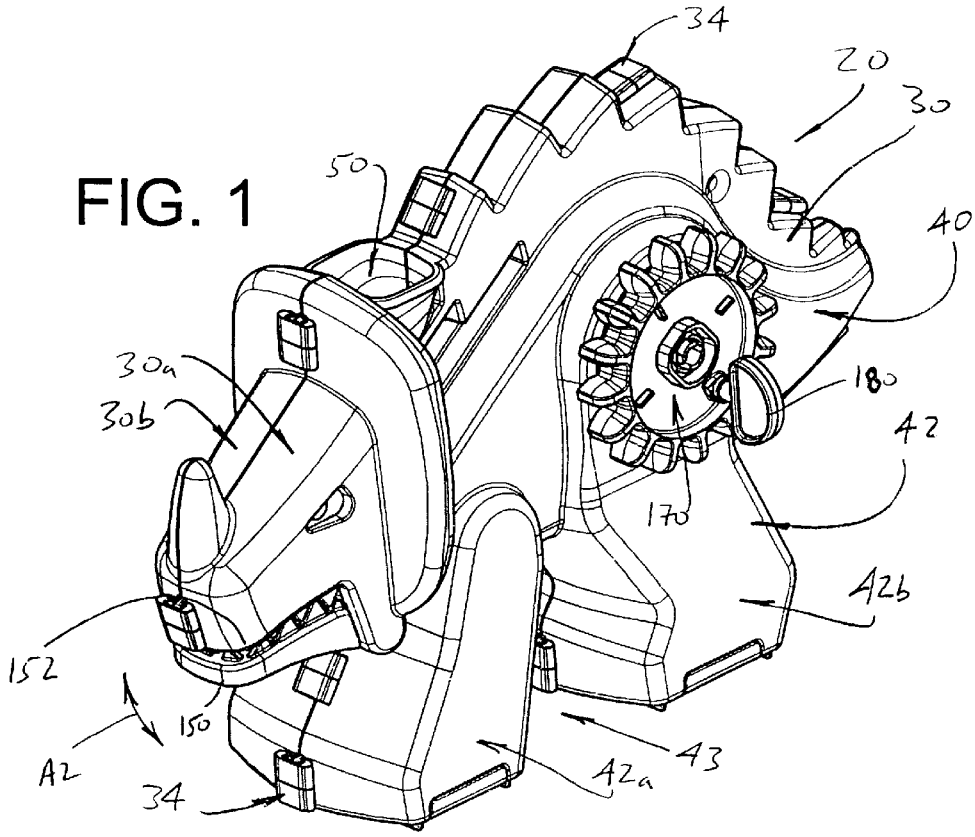
FIG. 1 is a perspective view of a coin sorting apparatus formed in accordance with the present invention in a first operative state.
Figure 2:
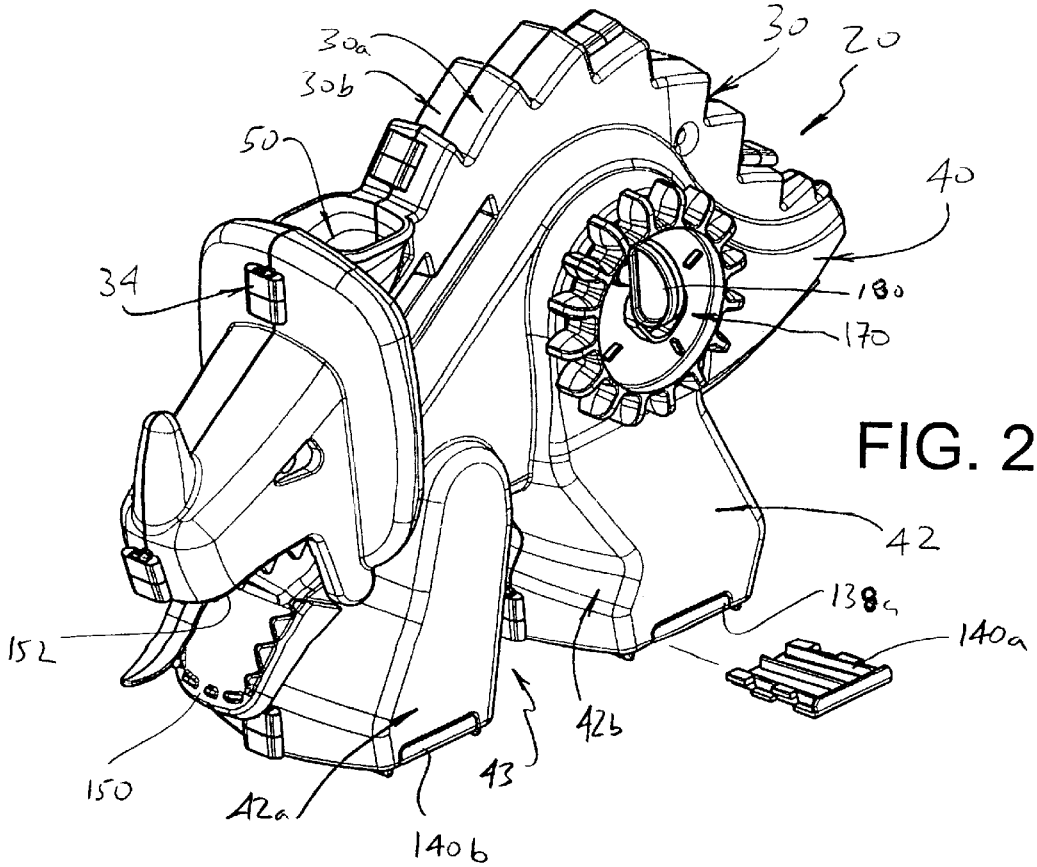
FIG. 2 shows that coin sorting apparatus of FIG. 1 in a second operative state.
Figure 3:
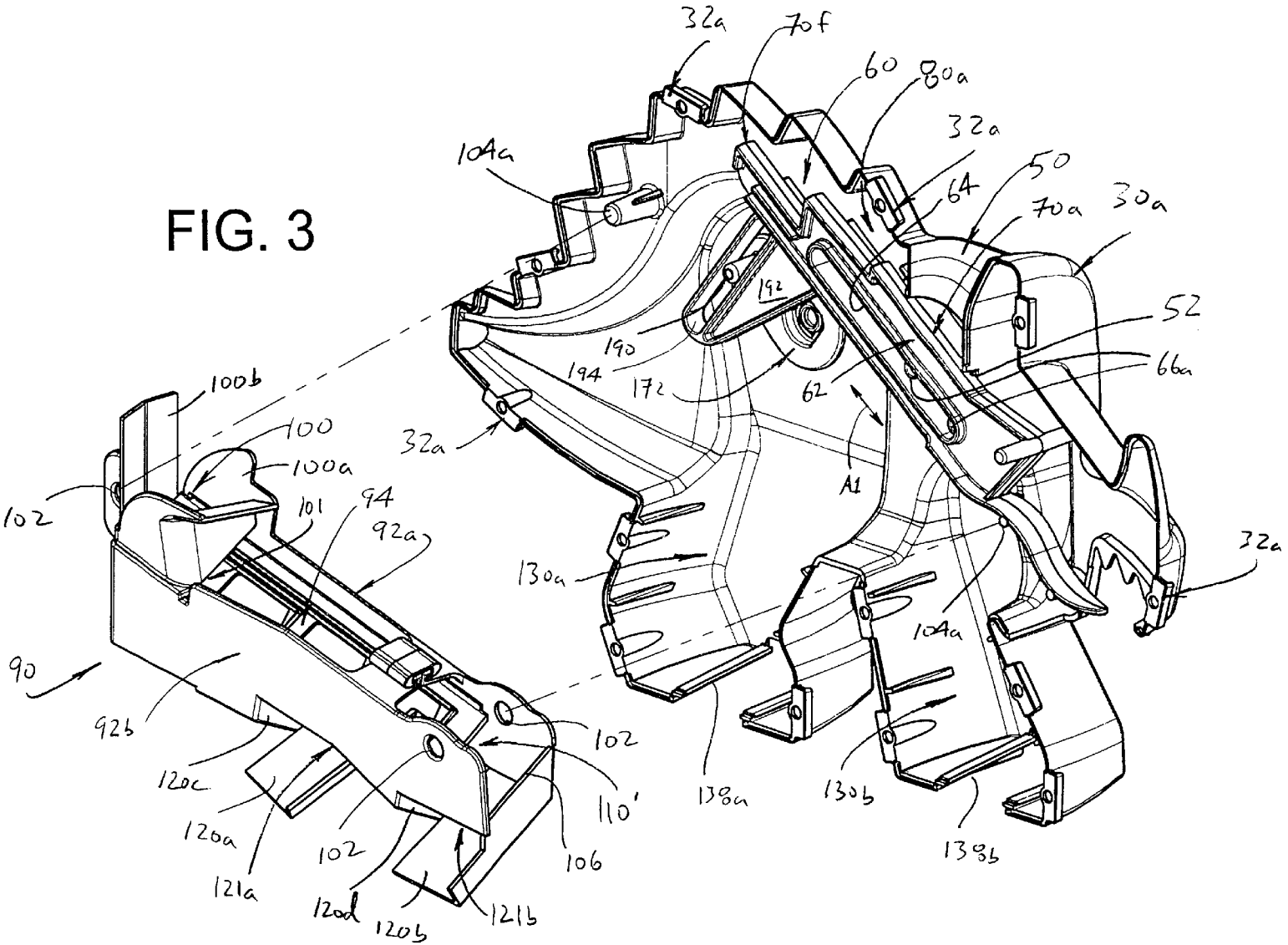
FIG. 3 is an exploded perspective view of a front housing section and internal components of the coin sorting apparatus of FIG. 1.

Referring now to the drawings, a coin sorting apparatus formed in accordance with the present invention is illustrated in FIGS. 1–3 and indicated generally at 20. The coin sorting apparatus comprises a substantially hollow molded plastic housing 30 defined from multiple interconnected housing sections, such as front and rear sections 30*a*,30*b*. In the illustrated embodiment, the housing sections 30*a*,30*b* define respective projecting tabs 32*a*,32*b* (see also FIG. 4) that lie adjacent each other when the housing sections are mated properly. A clip 34 is slidably or otherwise connected to each pair of adjacent tabs to hold the tabs and, consequently, the housing sections 30*a*,30*b* together. The clips 34 are preferably C-shaped in cross-section so that the mated tabs 32*a*,32*b* are slidably received in an open central channel thereof. Of course, screws or other fasteners can be employed without departing from the overall scope and intent of the invention.

All housing sections are preferably defined from clear or tinted transparent molded plastic so that objects such as coins or internal components of the coin sorting apparatus 20 are visible therethrough. The housing 30 comprises a body portion 40 defining a first interior space and a base portion 42 defining a second interior space and that supports the body portion 40 above a floor, table, or similar horizontal or nearly horizontal support surface. The body portion 40 contains all coin sorting components and the base portion 42 is used only for storage of sorted coins. It is most preferred, as illustrated in the drawings, that the housing 30 be defined in the shape of an animal (such as a dinosaur) with the body portion 40 corresponding to and representing the head and body of the animal and the base portion 42 corresponding to and representing the legs of the animal. Further, the base portion 42, itself, is divided into first and second legs 42*a*,42*b* that are separated by a gap 43.

Figure 4:
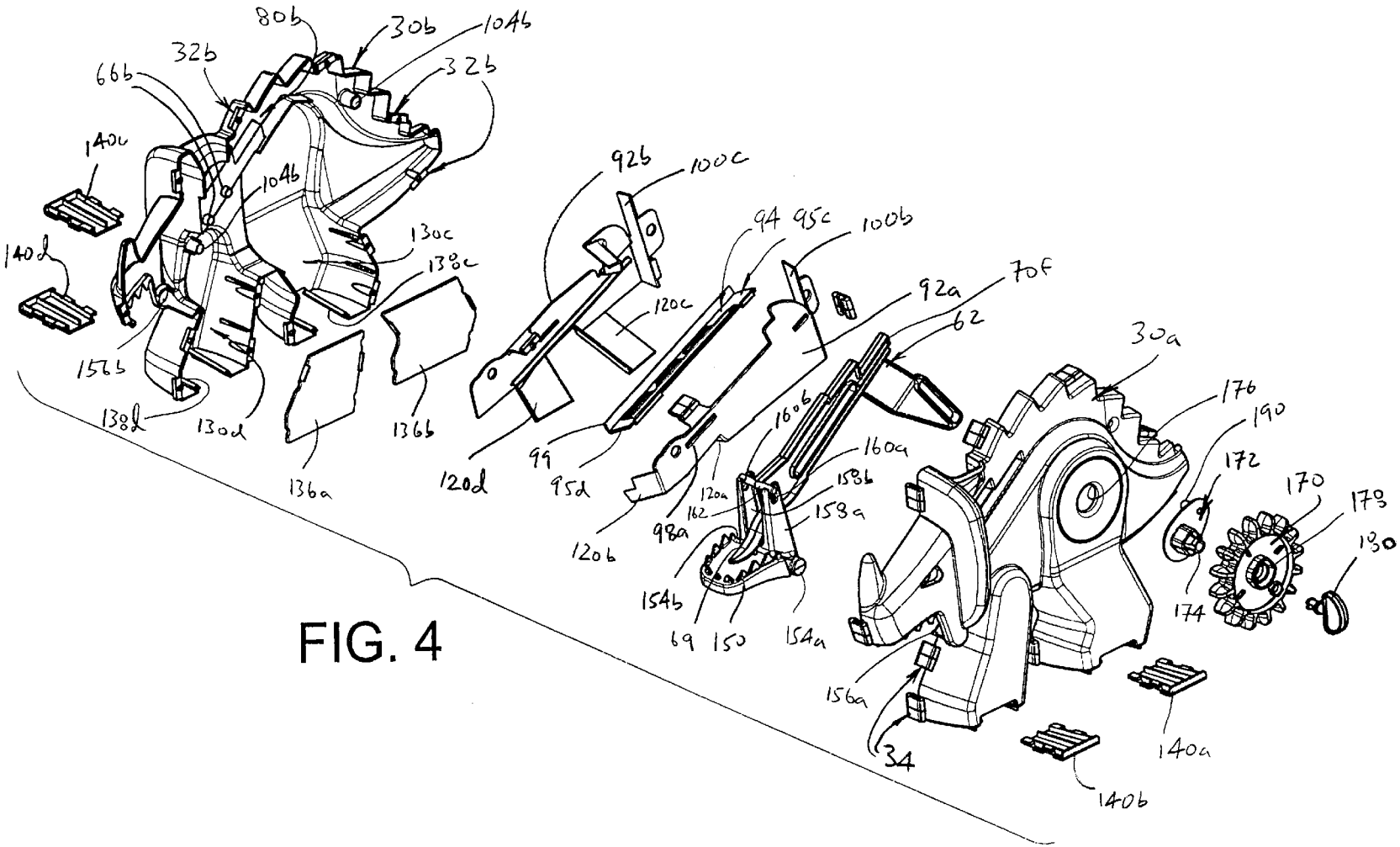
FIG. 4 is an exploded perspective view of the coin sorting apparatus shown in FIG. 1.

The housing 30 defines a coin entrance 50 sized to receive coins to be sorted and located to feed received coins by gravity to a coin lifting or transport assembly 60 located inside the housing 30. With particular reference to FIG. 3, the coin transport assembly comprises a coin transport member 62 supported within the housing and adapted for linear reciprocal movement relative to the housing as indicated by the arrow A1. In particular, the coin transport member 62 defines an elongated slot 64 that receives studs 66*a*,66*b* that project outwardly from the respective housing sections 30*a*,30*b* (studs 66*b* are shown in FIG. 4).

Figure 5:
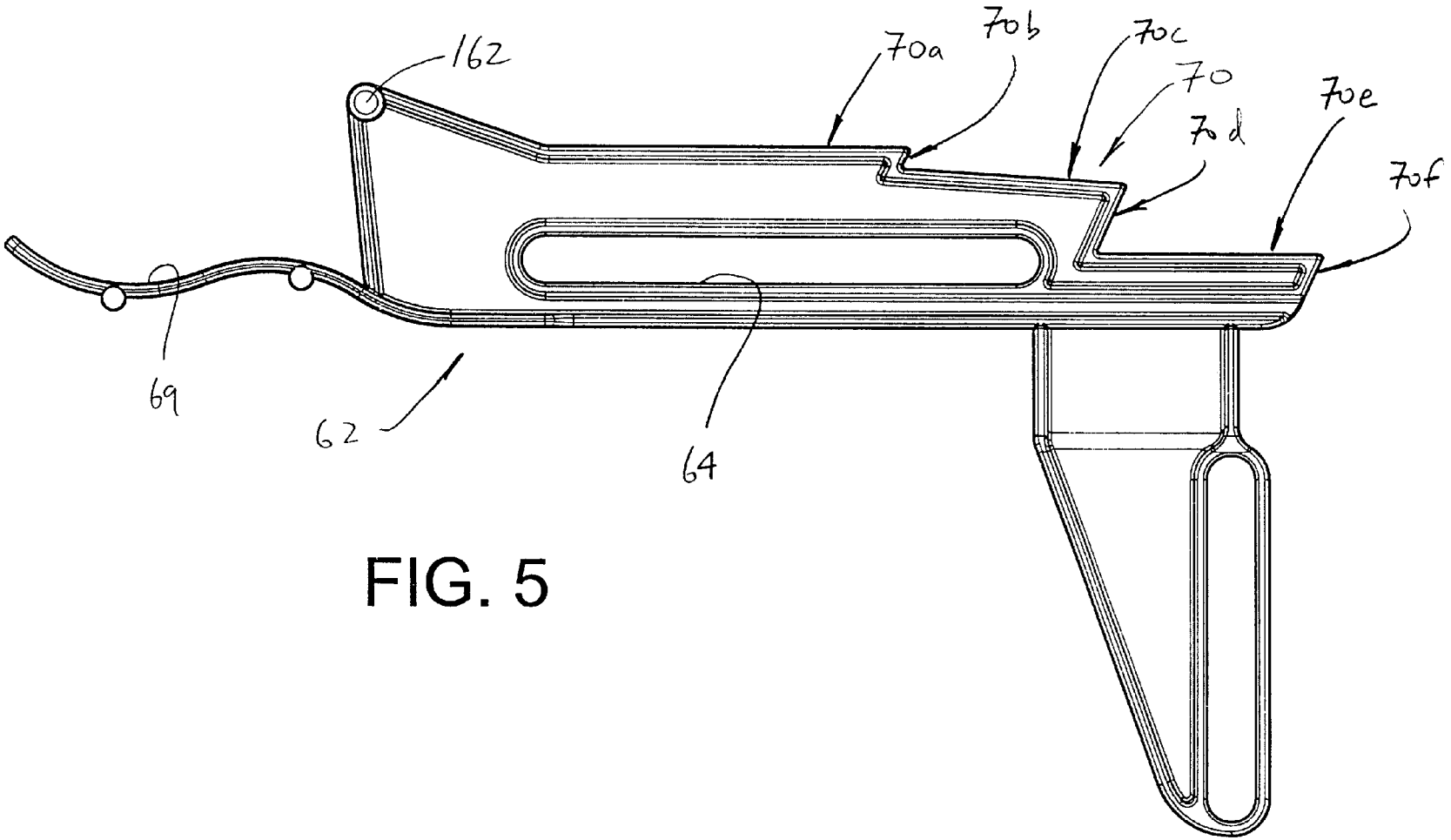
FIG. 5 illustrates a coin transport member of a coin sorter formed in accordance with the present invention.

The coin transport member 62, shown separately in FIG. 5, defines a stepped surface 70 including run surfaces 70*a*, 70*c* and 70*e* and rise surfaces 70*b*, 70*d* and 70*f*. The housing section 30*a* defines an internal stepped surface 80*a* and the housing section 30*b* defines a corresponding internal stepped surface 80*b*. When the housing sections 30*a*,30*b* are mated, the stepped surfaces 80*a*,80*b* are aligned with each other and located adjacent the reciprocating coin transport member 62 on opposite sides thereof. As is generally known in the art, reciprocation of the stepped coin transport member 62 between the two stationary stepped surfaces 80*a*,80*b* results in a coin being indexed upwardly in a step-wise fashion on the stepped surfaces 80*a*,80*b* by the coin transport member 62 from a first elevation adjacent the entrance 50 to a second higher elevation above the associated support surface on which the coin sorter is positioned. The height of the rise surface 70*b* of the coin transport member is selected to be less than the thickness of the thinnest coin being handled to prevent the surface 70*b* from acting on two stacked coins. Furthermore, as shown in FIG. 3, the coin entrance 50 is located relative to the run surface 70*a* of the coin transport member 62 so that even the thinnest coin being handled cannot pass between a lower edge 52 the inlet and the surface 70*a*.

With continuing reference to FIG. 3, the rise surface 70*f* is located at a first end of the coin transport member 62. A coin indexed up the stepped surfaces 80*a*,80*b* by the reciprocating coin transport member 62 will ultimately be pushed by the surface 70*f* off of the stepped surfaces 80*a*,80*b* into a coin sorting assembly 90. The coin transport member includes an elongated tongue 69 that projects from a second end opposite the surface 70*f*.

Figure 6:
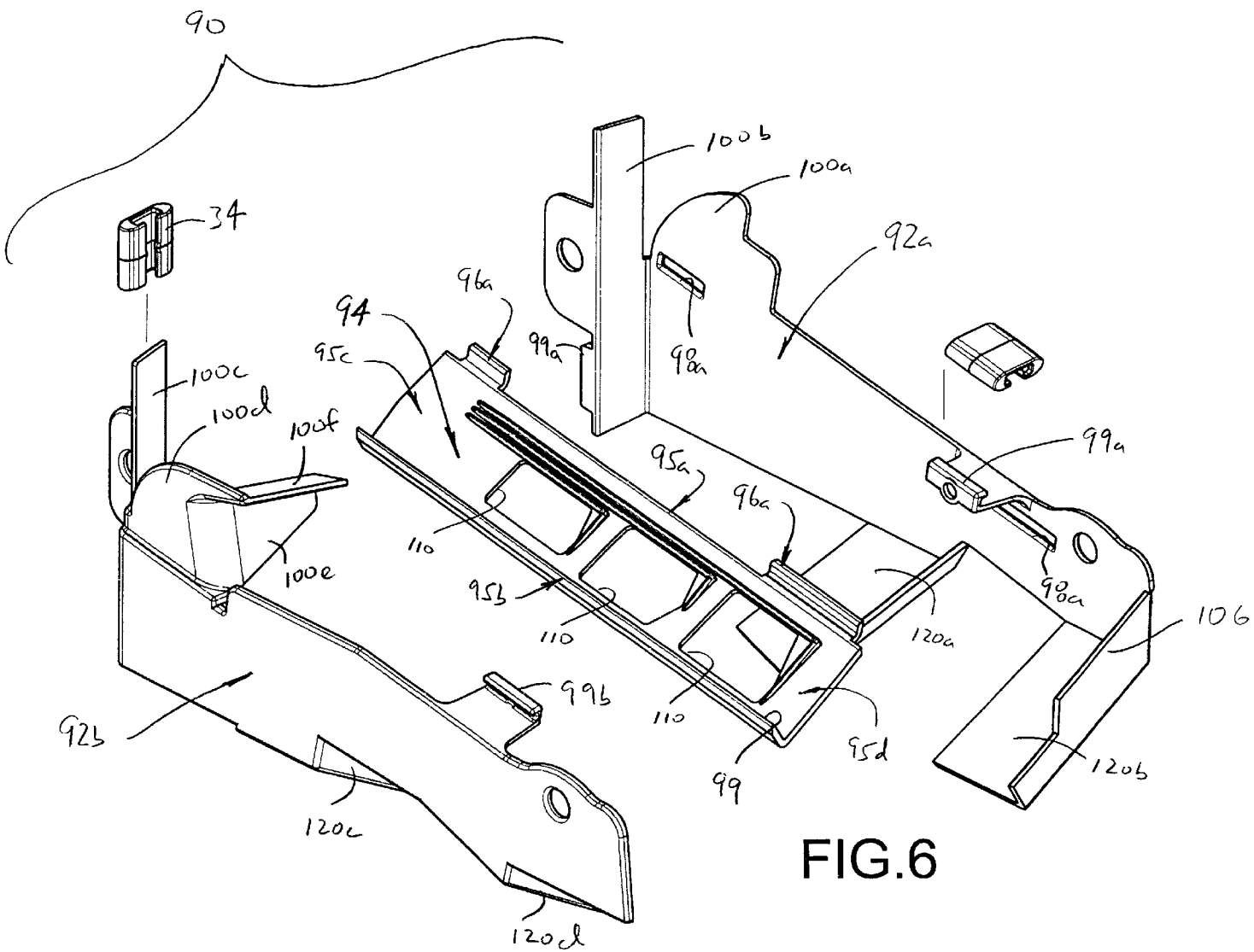
FIG. 6 is an exploded perspective view of a coin chute assembly of a coin sorter formed in accordance with the present invention.
Figure 7:
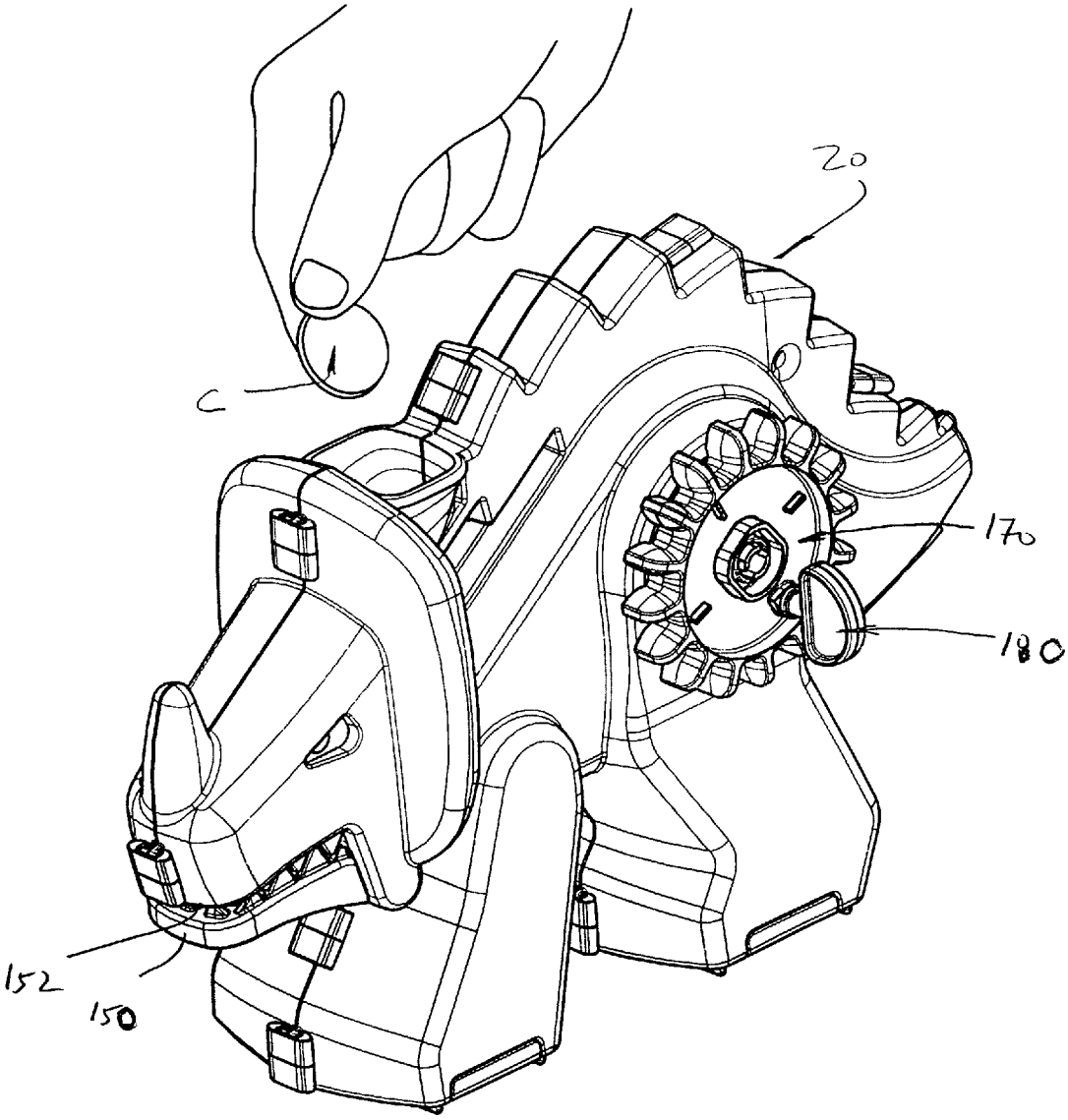
FIGS. 7 and 8 are perspective views that illustrate operation of a coin sorting apparatus formed in accordance with the present invention.

An exploded view of the coin sorting assembly 90 is provided in FIG. 6. It comprises first and second interconnected sidewalls 92*a*,92*b* located on opposite lateral sides of a coin sorting slide 94. The coin sorting slide 94 includes upturned tabs 96*a* that project from a first lateral side 95*a* thereof, and these tabs 96*a* are received in corresponding slots 98*a* defined in the first sidewall 92*a*. With the upturned tabs 96*a* inserted in the slots 98*a*, the slide 94 is suspended from the first sidewall 92*a*, with the first lateral side 95*a* thereof located at a higher elevation than the second lateral side 95*b* relative to the support surface on which the apparatus 20 is positioned. The second lateral side 95*b* includes an upturned flange 99 that prevents coins from moving laterally off of the slide 94.

The second sidewall 92*b* of the sorting assembly 90 is secured to the first sidewall 92*a* using the clips 34 that engage abutting tabs 99*a*,99*b* that are identical to the tabs 32*a*,32*b* described above and that project respectively from the sidewalls 92*a*,92*b*.

The coin sorting assembly 90, shown assembled in FIG. 3, includes a coin inlet 100 that receives coins that are pushed off of the stepped surfaces 80*a*,80*b* by the coin transport member 62. This coin inlet 100 is preferably defined by walls 100*a*,100*b* that project outwardly from the sidewall 92*a* and walls 100*c-e* that project upwardly from the sidewall 92*b*. The outermost portion of the wall 100*e* is preferably turned outwardly away from the walls 100*b*,100*c* and defines a lip 100*f*. Coins moving from the stepped surfaces 80*a*,80*b* to the inlet 100 drop onto the lip 100*f* where they slide or bounce into the inlet 100.

To prevent coins from bouncing from the inlet 100 onto the coin slide 94, the wall 100*e* is shaped so that a slot 101 is defined between the wall 100*e* and the coin slide 94. The slot 101 is dimensioned so that coins that enter the inlet 100 are prevented from bouncing or rolling onto the coin slide 94. Instead, to move from the inlet 100 to the slide 94, coins must pass through the slot 101 on one of their faces.

As shown in FIGS. 4 and 6, the sorting assembly 90 is secured in the housing 30 via apertures 102 defined in the sorting assembly 90 and mating studs 104*a*,104*b* that project respectively from the housing sections 30*a*,30*b*. In particular, the studs 104*a*,104*b* are received in the apertures 102 when the housing sections 30*a*,30*b* are assembled together to define the housing 30 as described above. With the sorting assembly 90 operatively secured between the housing sections 30*a*,30*b*, and with the base portion 42 of the coin sorting apparatus 20 supported on a horizontal support surface, an upper end 95*c* of the coin slide 94 is located at a higher elevation than a lower end 95*d* of the coin slide. The slide is inclined downwardly from the upper end 95*c* toward the lower end 95*d* at a sufficient angle so that coins deposited on the upper end 95*c* will move on one of their faces under force of gravity toward the lower end 95*d*. However, this incline angle of the slide 94 is limited so that coins slidably moving on the slide 94 do not move faster than desired as would prevent effective sorting thereof. It is most preferred that the coin slide 94 be located vertically beneath the reciprocating coin transport member 62 and arranged to that coins on the slide 94 move in a direction opposite the direction in which coins are moved by the coin transport member 62.

Coin sorting slides 94 are generally known and include a plurality of apertures 110 defined therein and arranged in order of increasing size moving toward the lower end 95*d* of the slide. A coin deposited on the upper end 95*c* of the slide 94 will fall through the first aperture encountered that will allow passage of that coin therethrough by gravity. In one embodiment, the number of apertures 110 is equal to the number of coin denominations being sorted. In the preferred embodiment illustrated herein, the number of apertures 110 is equal to one less than the number of coin denominations being sorted. In this preferred configuration, coins that pass over all apertures slide off of the lower end 95*d* of the slide 94 through a space 110' defined between the end 95*d* of the slide and an end wall 106 connected to the sidewall 92*a*. Other types of coin sorting ramps and slides are known for sorting coins that roll and/or slide thereon. These include helical coin sorting ramps on which coins roll on edge. It is not intended that the present invention be limited to the particular coin sorting slide shown herein.

The coin sorting apparatus comprises a plurality of coin chutes that receive coins from the slide 94 and convey the coins to respective sorted coin containers. As shown in FIGS. 3 and 4, the sidewall 92*a* of the slide assembly 90 includes first and second coin chutes 120*a*,120*b* that project outwardly therefrom toward the opposite sidewall 92*b* and beneath the coin slide 94, i.e., the chutes are located to receive coins that fall from the slide 94. The second sidewall 92*b* includes third and fourth coin chutes 120*c*,120*d* that project outwardly therefrom toward the opposite sidewall 92*a* and beneath the coin slide 94. The chutes 120*a*–120*d* are located relative to the slide 94 so that each chute receives one denomination of sorted coins from the slide 94.

Figure 9:
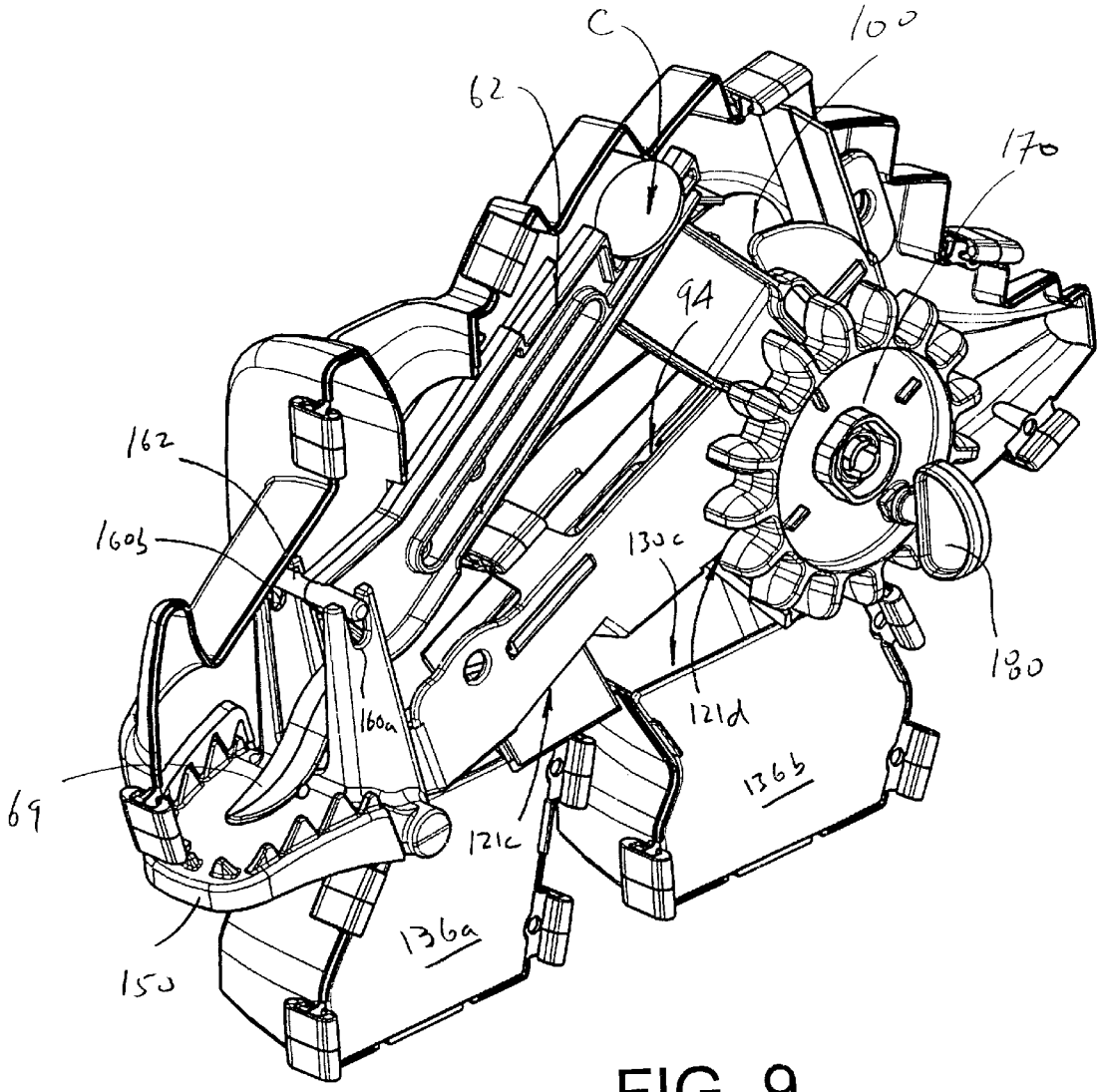
FIG. 9 is a perspective view of the coin sorting apparatus of FIG. 1, with the front housing section removed; and, FIG. 10 is a perspective view of the coin sorting apparatus of FIG. 1 showing separation of a coin door from the housing to dispense coins.

To prevent coins from bouncing or rolling on the chutes 120*a*,120*b*, these chutes pass close to the opposite sidewall 92*b* so that a slots 121*a*,121*b* are defined between the chutes 120*a*,120*b* and the sidewall 92*b*, respectively. Likewise, to prevent coins from bouncing or rolling on the chutes 120*c*, 120*d*, these chutes pass close to the opposite sidewall 92*a* so that a slots 121*c*,121*d* (FIG. 9) are defined between the chutes 120*c*,120*d* and the opposite sidewall 92*a*, respectively. These slots 121*a*–121*d* are dimensioned so that coins can pass therethrough only while sliding on the chutes 120*a*–120*d* on a front or rear coin face.

Figure 8:
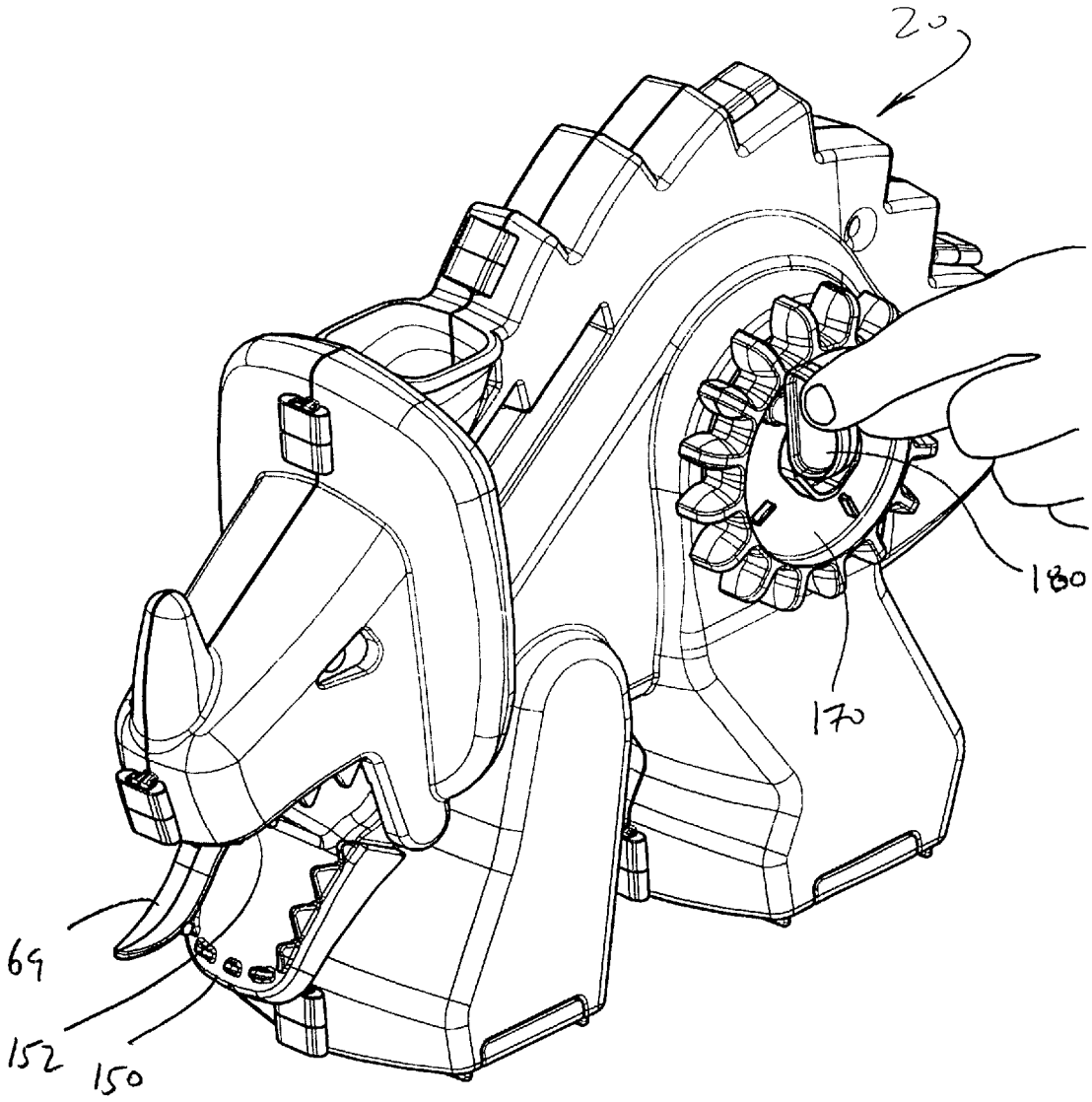

The base portion 42 of the housing 30 defines a plurality of separate sorted coin receiving chambers or regions. In the illustrates embodiment, as shown in FIGS. 3 and 4, four separate chambers 130*a*,130*b*,130*c*,130*d* are defined, with two of these located in each leg 42*a*,42*b*. As illustrated in FIGS. 4 and 8, dividing walls 136*a*,136*b* are located in the legs 42*a*,42*b* and divide the leg into two separate chambers 130*b*,130*d* and 130*a*,130*c*, respectively. An upper portion of each chamber 130*a*–130*d* is open to receive coins from the chutes 120*a*–120*d*, respectively.

The coin receiving chambers 130*a*–130*d* define respective coin outlets 138*a*–138*d* through which sorted coins in the chamber will exit the chamber and housing 30 under force of gravity. To prevent coins from exiting the chambers 130*a*–130*d*, a plurality of coin doors 140*a*–140*d* are provided and selectively connectable to the housing 30 in covering relation with the respective outlets 138*a*–138*d*. The coin sorting apparatus 20 further comprises a plurality of coin doors that correspond in number to the number of chambers 130*a*–130*d*. As shown in FIGS. 3 and 4, four coin doors 140*a*–140*d* are provided and are selectively connectable to and removable from the housing 30. In the preferred embodiment, the coin doors are slidably connectable to the housing 30. However, these doors 140*a*–140*d* can also be hingedly connected to the housing 30 and movable between a first position where they block their respective outlet 138*a*–138*d* and a second position where they do not block their respective outlet.

As a novelty feature, the coin sorter 20 comprises a movable member 150 secured to the body portion 40 of the housing 30 and adapted for movement relative to the housing body portion, e.g., on an arc A2 between a first position (FIG. 1) and a second position (FIG. 2). In the first position, the movable member 150 lies adjacent a mating portion 152 of the body portion 40. In the second position, the movable member is pivoted away from the mating portion 152. In the illustrated embodiment, the movable member corresponds to and represents the jaw of the animal represented by the housing 30.

As shown in FIG. 4, the movable member 150 includes like trunnions 154*a*,154*b* projecting outwardly from opposite sides thereof. These are received in recesses 156*a*,156*b* defined in the housing sections 30*a*,30*b*, respectively. First and second link members 158*a*,158*b* project outwardly from the movable member 150 adjacent the trunnions 154*a*,154*b* and define respective open recesses 160*a*,160*b* in an outermost end. The coin transport member 62 includes a cross-bar 162, and the opposite ends of the cross-bar are respectively received in the recesses 160*a*,160*b*, with the tongue portion 69 of the coin transport member 62 extending between the link members 158*a*,158*b*. Owing to this operative connection between the coin transport member 62 and the movable member 150, those of ordinary skill in the art will recognize that linear reciprocation of the coin transport member 62 will, in turn, cause reciprocation of the movable member 150 on the arc A2. Also, as shown in FIG. 2, when the movable member 150 is in its second operative position, the tongue 69 of the coin transport member 62 projects outwardly from the housing 30 between the movable member 150 and the mating member 152.

The coin sorting apparatus 20 includes a drive system operably coupled to the coin transport member 62 to reciprocate the coin transport member 62 as described. The drive system can be a battery-operated or other type of electric motor. As illustrated in FIG. 4, the drive system is purely manual and comprises an input gear 170 and a hub 172. The hub is positioned within the housing 30 adjacent the section 30*a* so that a spindle portion 174 thereof projects through an aperture 176 defined in the housing section 30*a*. The gear 170 is located external to the housing 30 and defines a central aperture 178 into which the hub spindle portion 174 is received slidably. When inserted into the aperture 178, the spindle portion 174 engages the gear 170 with a friction-fit or a snap-fit so that the gear 170 and hub 172 are drivingly coupled together and rotate as a unit relative to the housing section 30*a*. A stem or crank 180 is received in a second, peripheral aperture 182 defined in the gear 170 so that the crank projects outwardly away from the gear 170 and housing section 30*a*. Preferably, the crank 180 is able to rotate in the aperture 182 so that a user is able to exert force on the crank to rotate the gear 170 without the crank 180 rotating in the user's hand.

Within the housing 30, the hub portion 172 includes a stud 190 that projects in a direction opposite the spindle 174, i.e., away from the housing section 30*a* toward the coin transport member 62. The stud 190 rotates with the hub 172 and gear 170. The coin transport member 62 includes a leg portion 192 that depends therefrom on a side opposite the stepped surface 70. The leg portion 192 defines an elongated slot 194 oriented transverse to the slot 64 that allows the coin transport member to reciprocate. The stud 190 is received in the slot 194 (see FIG. 3) and is slidable therein. Those of ordinary skill in the art will recognize that rotation of the gear/hub combination 170,172 will result in rotation of the stud 190 which will cause reciprocation of the coin transport member 62 as indicated by the arrow A1 in FIG. 3. Of course, other manual drive systems can be used to reciprocate the coin transport member without departing from the overall scope and intent of the present invention.

In an alternative embodiment, the housing section 30*a* defines an elongated slot parallel to the path A1 on which the coin transport member 62 reciprocates. A stem or the like is connected to the member 62 and projects through the slot. Reciprocal movement of the stem in the slot by manual force results in the desired reciprocal movement of the coin transport member 62.

Figure 10:
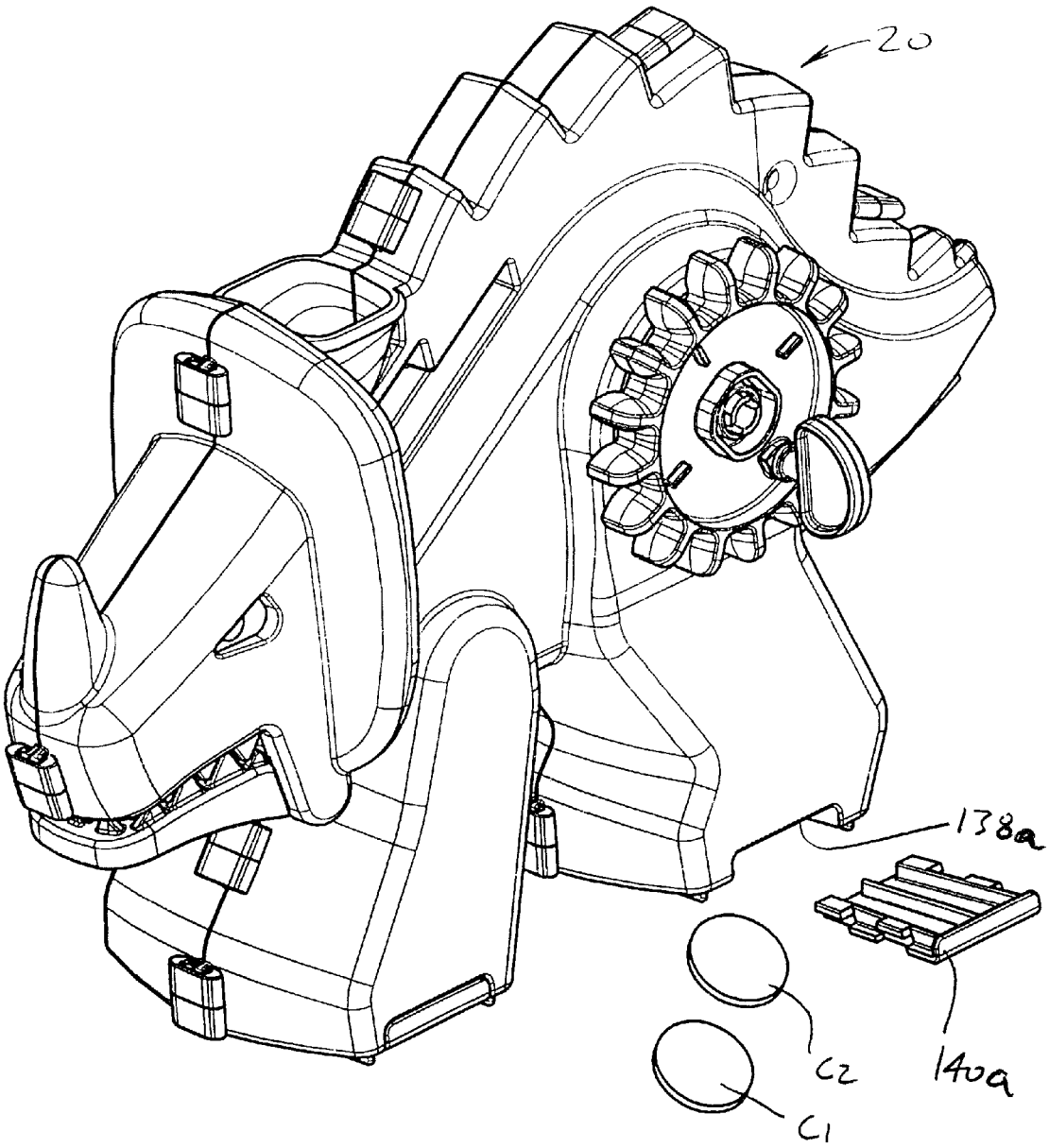

Operation of the coin sorter is best understood with reference to FIGS. 7–10. A user deposits one of more coins such as the coin C into the coin entrance 50. The user then manually rotates the gear 170 via crank 180 so that the coin transport member 62 FIG. 9 reciprocates and moves the coin C up the stepped surfaces 80*a*,80*b* (FIG. 9) so that the coin ultimately drops by gravity in to the inlet 100 of the coin sorting assembly 90. The coin then slides on one of its faces down the slide 94 and is conveyed as described above into one of the sorted coin chambers 130*a*–130*d*. While the coin transport member 62 reciprocates, the movable member 150 pivots between its first and second positions as described. FIG. 10 shows sorted coins C1,C2 being dispensed from the chamber 130*a* by separation of the associated coin door 140*a* from the housing 30 so that the coin outlet 138*a* is opened. Coins are selectively releasable from the chambers 130*b*–130*d* in a similar fashion.

The invention has been described with reference to a preferred embodiment. Obviously, modifications and alterations will occur to others upon reading and understanding the preceding specification. It is intended that the invention be construed as including all such modifications and alterations insofar as they fall within the scope of the appended claims as construed literally or in accordance with the doctrine of equivalents.

Having thus described the preferred embodiments, what is claimed is:

1. A coin sorting apparatus comprising:

a housing including a body portion and a base portion that supports the body portion above an associated support surface, said base portion defining a plurality of separate sorted coin chambers;

a coin entrance defined by said housing;

a coin transport assembly that receives individual associated coins from said coin entrance and moves said individual associated coins upwardly in said housing from a first elevation adjacent said entrance to a second, higher elevation relative to said associated support surface;

a coin sorting assembly including an inlet positioned to receive said individual associated coins from said coin transport assembly, said coin sorting assembly including a coin sorter that classifies said individual associated coins as one of a plurality of different denominations according to diameter; and, a plurality of coin chutes located to receive said individual associated coins from said coin sorting assembly and convey said received coins to a respective one of said plurality of sorted coin chambers, each chute receiving coins having only one of said plurality of different denominations.

2. The coin sorting apparatus as set forth in claim 1, further comprising:

a manual drive system operably coupled to said coin transport assembly.

3. The coin sorting apparatus as set forth in claim 2, wherein said coin transport assembly comprises:

a stepped surface defined by said housing that extends from said first elevation to said second elevation;

and a coin transport member movably supported by said housing adjacent said stepped surface, said coin transport member operably coupled to said manual drive system and movable in a linear reciprocating fashion in response to operation of said manual drive system to index said associated individual coins upwardly on said stepped surface from said first elevation to said second elevation.

4. The coin sorting apparatus as set forth in claim 3, further comprising:

a movable member connected to said housing and operably coupled to said manual drive system and movable between first and second positions relative to said housing in response to operation of said manual drive system.

5. The coin sorting apparatus as set forth in claim 4, wherein said coin transport member comprises a tongue projecting therefrom, and wherein said tongue projects out of said housing when said movable member is in its second operative position.

6. The coin sorting apparatus as set forth in claim 1, wherein said housing defines a coin outlet opening in each of said sorted coin containers, and wherein said apparatus further comprises:

a plurality of coin door members selectively connectable to said housing in respective covering relation with said coin outlet openings.

7. A coin sorting apparatus comprising:

a housing including a body portion and a base portion that supports the body portion above an associated support surface, said base portion defining a plurality of separate sorted coin chambers;

a coin entrance defined by said housing;

a coin transport assembly that receives individual associated coins from said coin entrance and that moves said individual associated coins in said housing from a first location to a second location;

a coin sorting assembly including an inlet positioned to receive said individual associated coins from said coin transport assembly, said coin sorting assembly including a coin sorter that classifies said individual associated coins as one of a plurality of different denominations according to diameter;

a manual drive system operably coupled to said coin transport assembly; and, a movable member connected to said housing and operably coupled to said manual drive system and movable between first and second positions relative to said housing in response to operation of said manual drive system.

8. The coin sorting apparatus as set forth in claim 7, wherein said coin transport assembly comprises:

a stepped surface defined by said housing that extends from said first elevation to said second elevation;

and a coin transport member movably supported by said housing adjacent said stepped surface, said coin transport member operably coupled to said manual drive system and movable in a linear reciprocating fashion in response to operation of said manual drive system to index said associated individual coins upwardly on said stepped surface from said first elevation to said second elevation.

9. The coin sorting apparatus as set forth in claim 7, wherein said coin transport member comprises a tongue projecting therefrom, and wherein said tongue projects out of said housing when said movable member is in its second operative position.

10. The coin sorting apparatus as set forth in claim 7, further comprising:

a plurality of coin chutes located to receive said individual associated coins from said coin sorting assembly and adapted to convey said received coins respectively to said plurality of sorted coin chambers, said plurality of coin chutes each receiving coins having only one of said plurality of different denominations.

11. A coin handling device comprising:

a housing including an upper portion defining a first interior space and an entrance to said first interior space, and a lower portion defining at least two spaced-apart legs that support said upper portion above an associated support surface, each of said legs defining a sorted coin compartment therein;

a coin sorting assembly located in said first interior space and including an inlet, a plurality of coin chutes and a coin sorter that communicates associated coins from said inlet to one of said plurality of chutes depending upon a diameter of said associated coins, each of said plurality of coin chutes located to convey coins from said coin sorter to one of said sorted coin compartments; and, a coin transport mechanism that moves individual associated coins from said housing entrance to said inlet of said coin sorting assembly.

12. The coin handling device as set forth in claim 11, further comprising a dividing wall located in at least one of said two spaced legs and dividing said sorted coin compartment of said at least one leg into at least two sorted coin compartments.

13. The coin handling device as set forth in claim 11, wherein said housing lower portion defines an outlet opening in communication with each sorted coin compartment, and wherein said coin handling device further comprises a coin door selectively positionable in covering relation with each of said outlet openings.

14. The coin handling device as set forth in claim 11, further comprising:

a manual drive system operably coupled to said coin transport mechanism whereby operation of said manual drive system causes operation of said coin transport mechanism.

15. The coin handling device as set forth in claim 14, wherein said manual drive system comprises a driving element having at least a portion extending through said housing.

16. The coin handling device as set forth in claim 15, further comprising a linkage connecting said driving element to said transport mechanism.

17. The coin handling device as set forth in claim 11, wherein at least one of said coin chutes conveys coins in a first direction and at least one of said coin chutes conveys coins in a second direction that is different from said first direction.

18. The coin handling device as set forth in claim 11, wherein said coin sorter comprises an inclined slide on which associated coins move on their faces.

19. The coin handling device as set forth in claim 14, further comprising:

a movable member extending through said housing and operably coupled to said manual drive system, said movable member movable reciprocally between first and second positions relative to said housing in response to operation of said manual drive system.

20. A coin handling device comprising:

a housing defining an interior space, an entrance to said interior space and a plurality of sorted coin compartments, said housing comprising an upper portion and a lower portion that supports said upper portion above an associated support surface, said lower portion defined by first and second spaced-apart legs separated by an open space, wherein said sorted coin compartments are located in said lower portion of said housing;

a coin transport mechanism located in said interior space and adapted for moving individual associated coins from said entrance to a second location in said interior space;

a coin sorter for classifying associated coins according to diameter; and, a movable member secured to said housing and operably coupled to said coin transport mechanism whereby said movable member moves relative to said housing when said transport mechanism moves said associated coins in said interior space.

21. The coin handling device as set forth in claim 20, further comprising:

a first dividing wall located in said first leg and dividing said first leg into two separate sorted coin compartment sections; and, a second dividing wall located in said second leg and dividing said second leg into two separate sorted coin compartment sections.

22. The coin handling device as set forth in claim 20, wherein said housing defines a plurality of sorted coin outlet openings in respective communication with said plurality of sorted coin compartments, and wherein said coin handling device further comprising:

a plurality of doors selectively positionable in covering relation with said plurality of sorted coin outlet openings, respectively.

23. The coin sorting device as set forth in claim 20, further comprising:

a manual drive system operably coupled to said coin transport mechanism whereby manual operation of said drive system drives said coin transport mechanism.

24. A coin handling device comprising:

a housing defining an interior space, an entrance to said interior space and a plurality of sorted coin compartments;

a coin transport mechanism located in said interior space and adapted for moving individual associated coins from said entrance to a second location in said interior space;

a coin sorter for classifying associated coins according to diameter;

a plurality of coin chutes located to receive associated coins of a plurality of different diameters from said coin sorter and to convey said received associated coins to said plurality of sorted coin compartments respectively; and, a movable member secured to said housing and operably coupled to said coin transport mechanism whereby said movable member moves relative to said housing when said transport mechanism moves said associated coins in said interior space.

25. The coin handling device as set forth in claim 24, wherein said coin sorter comprises a coin slide located between first and second lateral sidewalls, and wherein at least one of said coin chutes extends from said first sidewall vertically beneath said slide toward and beyond said second sidewall.

26. The coin handling device as set forth in claim 25, wherein each of said chutes extends from one of said first and second sidewalls vertically beneath said slide and toward and beyond the other of said first and second sidewalls whereby, for each of said chutes, the other sidewall is located to deflect associated coins traveling thereon onto a coin face.

27. The coin handling device as set forth in claim 26, wherein said coin sorter comprises:

an inlet located to communicate coins by gravity from said coin transport mechanism to said slide; and, a deflector positioned adjacent and defining a slot with said slide through which associated coins can pass only on one of their faces.

28. A coin sorting apparatus comprising:

a housing including a body portion and a base portion that supports the body portion above an associated support surface, said base portion comprising a pair of spaced legs and said body portion defined to represent a torso and head of an animal;

a coin entrance in said body portion;

a coin sorting assembly located in said body portion and communicating with said coin entrance; and, at least two coin storage areas communicating with said coin sorting assembly, said at least two storage areas located in at least one of said pair of spaced legs of said base portion.

29. The coin sorting apparatus as set forth in claim 28, further comprising:

a coin transport mechanism that moves coins from said entrance to said sorting assembly.

30. The coin sorting apparatus as set forth in claim 29, further comprising:

a manual drive system operably coupled to said coin transport mechanism.

31. The coin sorting apparatus as set forth in claim 30, further comprising:

a movable member mounted to said body portion and moved by said manual drive system relative to said body portion together with said coin transport mechanism.

* * * * *